US008752910B2

(12) United States Patent
Lin

(10) Patent No.: US 8,752,910 B2
(45) Date of Patent: Jun. 17, 2014

(54) WORKTABLE APPARATUS

(75) Inventor: Da-Sen Lin, Taichung (TW)

(73) Assignee: Pard Hardware Industrial Co., Ltd., Taichung (TW)

( * ) Notice: Subject to any disclaimer, the term of this patent is extended or adjusted under 35 U.S.C. 154(b) by 141 days.

(21) Appl. No.: 13/338,118

(22) Filed: Dec. 27, 2011

(65) Prior Publication Data

US 2013/0160229 A1 Jun. 27, 2013

(51) Int. Cl.
*A47B 81/00* (2006.01)

(52) U.S. Cl.
USPC ..... 312/212; 312/228; 312/229

(58) Field of Classification Search
CPC .. A47B 2037/005; A47B 33/00; A47B 37/00; A47B 77/06; A47B 81/00; A47B 3/087
USPC ..... 312/228, 228.1, 211–212, 311, 229; 134/22.12, 22.18; 108/24, 50.18
See application file for complete search history.

(56) References Cited

U.S. PATENT DOCUMENTS 1,665,986 A * 4/1928 Side ..... 312/229
1,734,466 A * 11/1929 Hoke et al. ..... 312/140.4
1,885,092 A * 10/1932 Fellerman ..... 312/140.1
2,328,129 A * 8/1943 Earle ..... 34/90
2,743,039 A * 4/1956 Smith ..... 141/98
2,814,809 A * 12/1957 Boyle ..... 4/630
3,041,957 A * 7/1962 Liptay ..... 454/56
3,715,972 A * 2/1973 Kelso et al. ..... 454/61
4,051,858 A * 10/1977 Mele ..... 134/56 R
4,052,227 A * 10/1977 Delo et al. ..... 134/56 R
4,408,642 A * 10/1983 Jeruzal et al. ..... 144/286.5
4,462,415 A * 7/1984 Otzen ..... 134/111
4,898,089 A * 2/1990 Roos ..... 454/49
4,992,639 A * 2/1991 Watkins et al. ..... 219/69.2
5,312,178 A * 5/1994 King ..... 312/140.4
5,318,056 A * 6/1994 Kusz et al. ..... 134/95.3
5,329,979 A * 7/1994 Miller et al. ..... 144/329
5,409,167 A * 4/1995 Borod ..... 239/152
5,502,848 A * 4/1996 Cowan ..... 4/619
5,665,412 A * 9/1997 Fuller et al. ..... 426/524
5,743,602 A * 4/1998 Maddux et al. ..... 312/140.1
6,050,660 A * 4/2000 Gurley ..... 312/249.1
6,189,805 B1 * 2/2001 West et al. ..... 239/74
6,401,274 B1 * 6/2002 Brown ..... 4/626
6,883,881 B2 * 4/2005 Gauss ..... 312/237
2004/0154648 A1 * 8/2004 Stout et al. ..... 134/25.4
2007/0018545 A1 * 1/2007 Calabria et al. ..... 312/311
2009/0194511 A1 * 8/2009 Luo et al. ..... 219/69.12

FOREIGN PATENT DOCUMENTS

JP 02027028 A * 1/1990 ..... E03C 1/18
JP 06121713 A * 5/1994 ..... A47B 37/00
JP 10053063 A * 2/1998 ..... B60P 3/36
JP 2003180462 A * 7/2003 ..... A47B 77/06
JP 2011005051 A * 1/2011

* cited by examiner

*Primary Examiner* — Hanh V Tran

(57) ABSTRACT

A worktable apparatus includes a worktable, a washing unit and a supporting unit. The worktable includes a horizontal board supported on posts. The washing unit includes a sink and a valve. The sink includes an opening defined in an upper portion and a drain defined in a lower portion. The valve is connected to the sink so that the drain is in communication with and under control of the valve. The supporting unit includes two rails, a tray and casters. The rails are connected to the worktable under the sink. The tray is placed between the rails. The casters are divided into two groups each connected to a respective one of two lateral edges of the tray and movably supported on a respective one of the rails.

6 Claims, 4 Drawing Sheets

WORKTABLE APPARATUS

BACKGROUND OF INVENTION

1. Field of Invention

The present invention relates to a worktable and, more particularly, to a worktable apparatus including a worktable and a washing unit.

2. Related Prior Art

As disclosed in Taiwanese Patent Nos. 505087, M316660, M356590 and M363252, a conventional worktable includes a horizontal board supported on posts. Hooks can be attached to a vertical board supported on the horizontal board. Tools, parts and other things can be placed in drawers attached to a lower face of the horizontal board. Trash can be cast in a trashcan attached to the lower face of the horizontal board.

Assembling and dissembling of machines and many other sorts of work can be done on the worktable. However, washing cannot be executed on the worktable since the worktable is not equipped with any washing unit. Hence, parts are taken from the worktable and washed somewhere else and placed on the worktable again so that measuring or any other sorts of work that require precision can be executed on the parts. This process is inconvenient and particularly so when parts must be submerged in detergent contained in a tank, bowl or any other sort of container placed somewhere else.

The present invention is therefore intended to obviate or at least alleviate the problems encountered in prior art.

SUMMARY OF INVENTION

It is the primary objective of the present invention to provide a worktable apparatus on which cleaning can be executed.

To achieve the foregoing objective, the worktable apparatus includes a worktable, a washing unit and a supporting unit. The worktable includes a horizontal board supported on posts. The washing unit includes a sink and a valve. The sink includes an opening defined in an upper portion and a drain defined in a lower portion. The valve is connected to the sink so that the drain is in communication with and under control of the valve. The supporting unit includes two rails, a tray and casters. The rails are connected to the worktable under the sink. The tray is placed between the rails. The casters are divided into two groups each connected to a respective one of two lateral edges of the tray and movably supported on a respective one of the rails.

In the worktable apparatus, the worktable may include a vertical board supported on the horizontal board.

In the worktable apparatus, the worktable may include a mat placed on the horizontal board. The mat is useful for avoiding static charges.

The worktable apparatus may include a basket supported on the sink so that the basket is placed across the opening.

The worktable apparatus may include a nozzle, a first container and a second container. The first container is placed on the tray, and includes an inlet port connected to an air compressor and an outlet port connected to the nozzle. The first container can be filled with detergent. The detergent can be carried out of the first container by pressurized air sent from the air compressor. The second container is placed on the tray, and includes a port via which the detergent, after use, can drop into the second container from the sink via the valve.

The worktable apparatus may include a flexible pipe for connecting the outlet port to the nozzle.

In the worktable apparatus, each of the rails may includes a stop for stopping one of the casters of a respective group.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
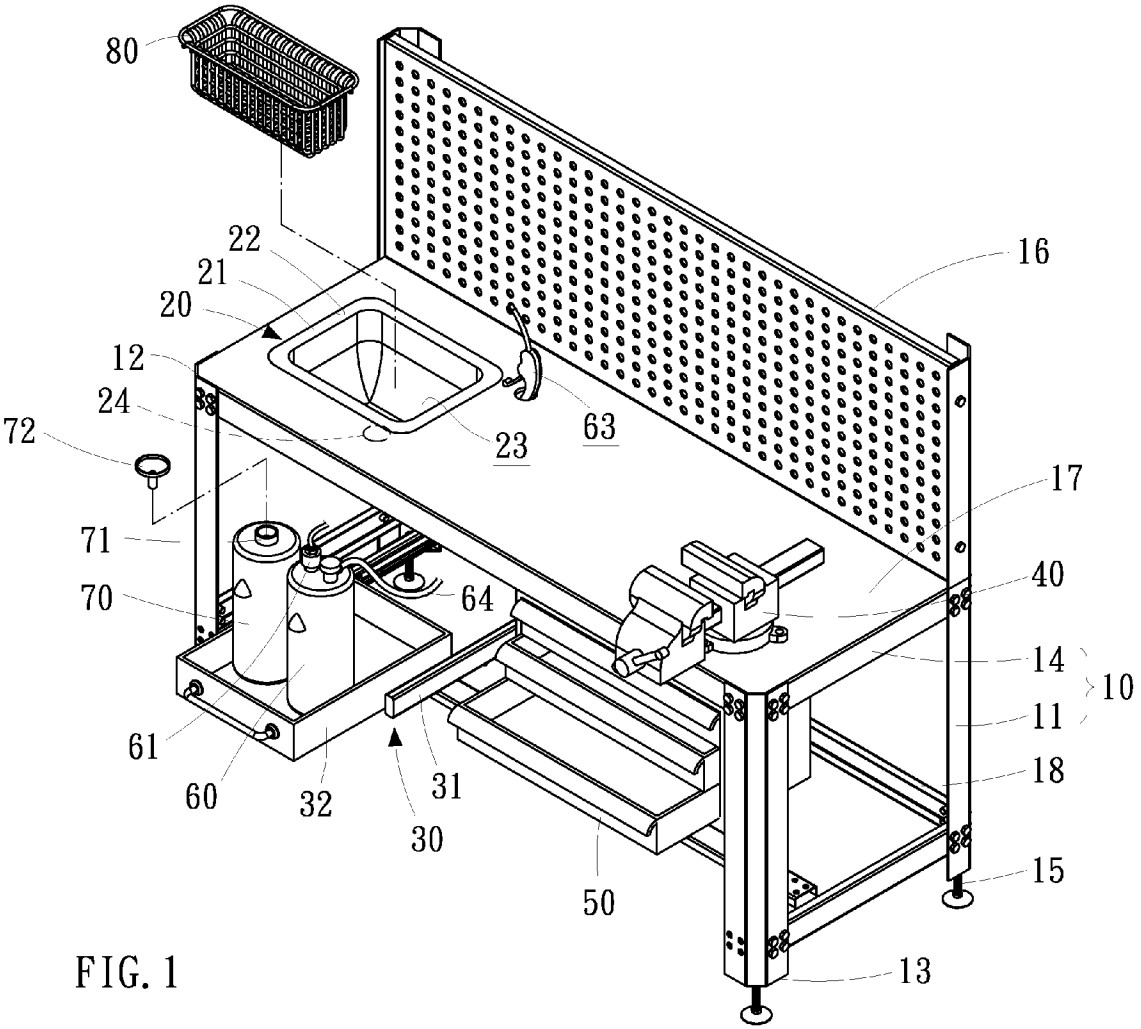
FIG. 1 is a perspective view of a worktable apparatus according to the preferred embodiment of the present invention.
Figure 2:
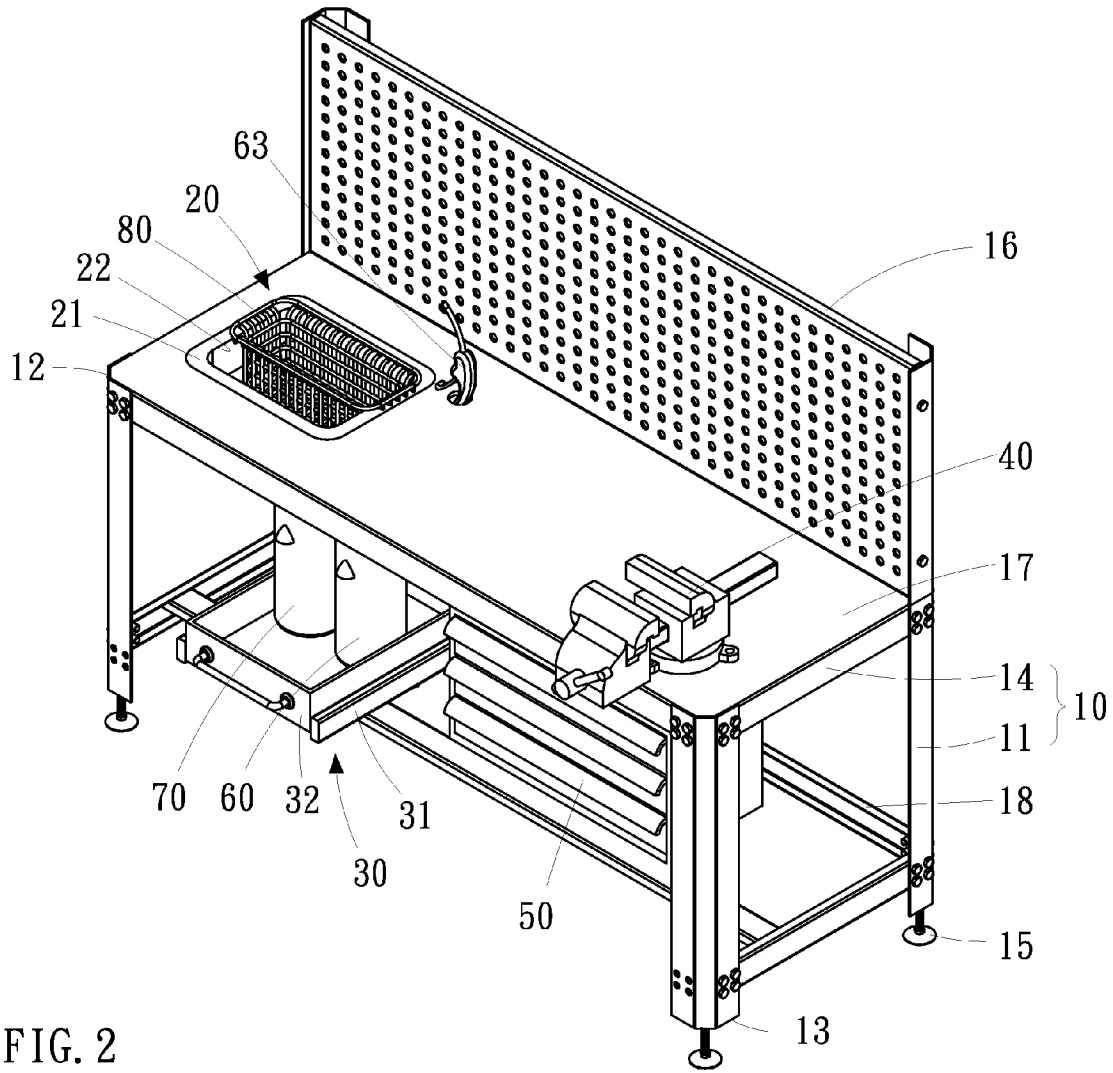
FIG. 2 is a perspective view of a worktable apparatus in another position than shown in FIG. 1.

Referring to FIGS. 1 and 2, there is shown a worktable apparatus in accordance with the preferred embodiment of the present invention. The worktable apparatus includes a worktable 10, a washing unit 20, a supporting unit 30, a vise 40, drawers 50, a first container 60 and a second container 70.

The worktable 10 includes posts 11, a horizontal board 14, elevation adjusters 15, a vertical board 16, a mat 17 and crossbars 18. Each of the posts 11 includes an upper end 12 connected to the horizontal board 14 and lower end 13 connected to a respective one of the elevation adjusters 15. The elevation adjusters 15 are placed on the ground or a floor. The elevation adjusters 15 can be operated to render the horizontal board 14 horizontal. The vertical board 16 is supported on the horizontal board 14. Hooks can be attached to the vertical board 16. The vertical board 16 is preferably in the form of a net that includes apertures each adapted for receiving a portion of a hook while another portion of the hook holds a work-piece, a tool or the like. The mat 17 is provided on the horizontal board 14. The mat 17 is used for cushioning work-pieces and avoiding static charges. Each of the crossbars 18 is used to interconnect two adjacent ones of the posts 11 below the horizontal board 14.

The vise 40 is connected to an upper face of the horizontal board 14. The vise 40 is operable to clamp machines and parts to be processed.

The drawers 50 are connected to a lower face of the horizontal board 14. Tools, parts and other things can be placed in the drawers 50.

Figure 3:
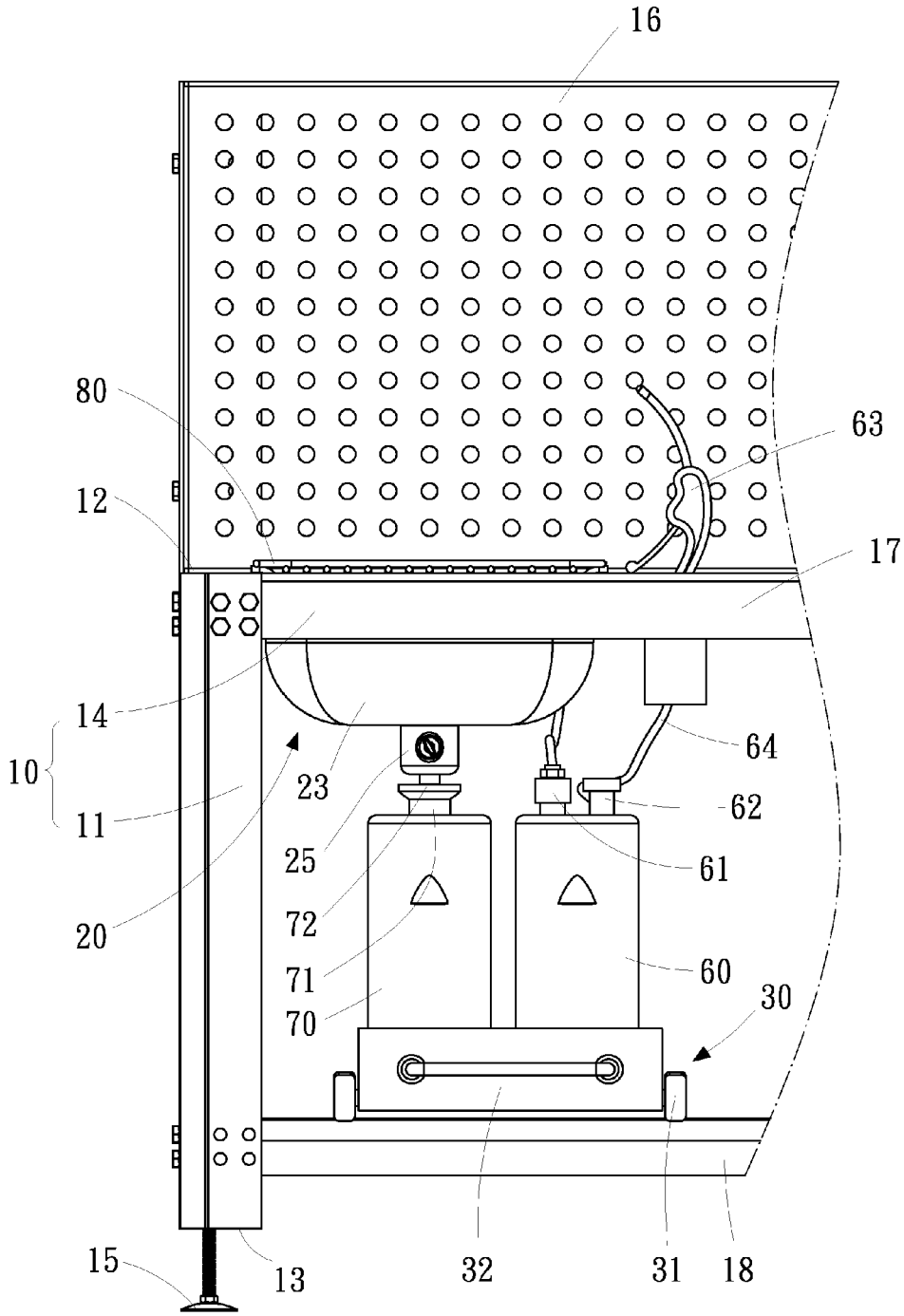
FIG. 3 is an enlarged, partial, front view of the worktable apparatus shown in FIG. 1.

The washing unit 20 includes a sink 21 and a valve 25. The sink 21 includes a continuous wall extending around and on a bottom plate 23. An opening 22 is defined by the edge of the continuous wall which is connected to the horizontal board 14 by welding for example. The sink 21 is made with an adequate depth measured from the opening 22 to the bottom plate 23. A drain 24 is defined in the bottom plate 23. As shown in FIG. 3, the valve 25 is connected to a lower face of the bottom plate 23 so that the drain 24 is in communication with and under control of the valve 25.

Figure 4:
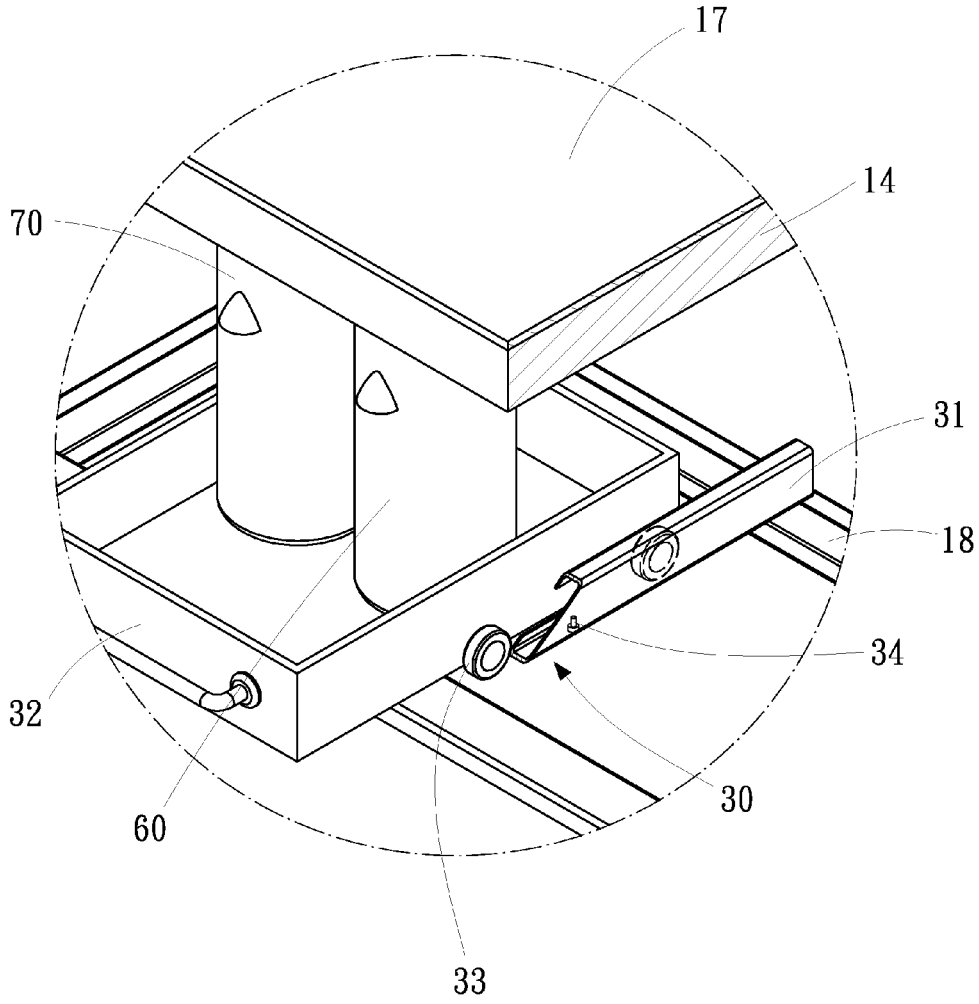
FIG. 4 is an enlarged, partial, perspective view of the worktable apparatus shown in FIG. 1.

The supporting unit 30 includes rails 31, a tray 32 and casters 33. Each of the rails 31 includes a C-shaped configuration in a cross-sectional view. The rails 31 are preferably connected to two of the crossbars 18 by welding for example. The rails 31 are located below the sink 21. The distance between the rails 31 is longer than the width of the tray 32. The casters 33 are divided into two groups each connected to a respective one of two lateral edges of the tray 32 and movably supported on a respective one of the rails 31. Thus, the tray 32 is movably supported on the rails 31. As shown in FIG. 4, each of the rails 31 includes a stop 34 formed thereon for contacting and stopping one of the casters 33 of a respective group. Thus, the tray 32 is kept on the rails 31.

The first container 60 is placed on the tray 32. The first container 60 is placed under the sink 21 as the tray 32 is withdrawn. The first container 60 includes an inlet port 61 and an outlet port 62. The inlet port 61 is connected to an air compressor (not shown) via a first flexible pipe. The outlet port 62 is connected to a nozzle 63 via a second flexible pipe 64.

In operation, the first container 60 is filled with detergent. Pressured air is sent out of the nozzle 63 from the air compressor via the first flexible pipe, the first container 60 and the second flexible pipe 64. The pressurized air carries the detergent out of the nozzle 63 from the first container 60 via the second flexible pipe 64. The detergent is provided on a machine or part in need of washing. The used detergent drops into the sink 21.

The second container 70 includes a port 71 defined therein. A lower section of a funnel is inserted in the second container 70 via the port 71. The second container 70 is placed on the tray 32. As the tray 32 is withdrawn, the second container 70 is placed under the valve 25 so that an upper section of the funnel is aligned to the valve 25.

The used detergent is sent into the second container 70 from the sink 21 via the drain 24 and the valve 25 in an open position. Thus, the used detergent is collected in the second container 70. The valve 25 is turned to a closed position before the second container 70 is moved beyond the sink 21 together with the tray 32. The lower section of the funnel is removed from the second container 70 before the used detergent is poured from the second container 70 via the port 71. Then, the lower section of the funnel is inserted into the second container 70 via the port 71, the second container 70 is placed on the tray 32, and the tray 32 is withdrawn. Thus, the second container 70 is ready for receiving more used detergent from the sink 21 via the drain 24, the valve 25 and the funnel.

Instead of providing the detergent onto the machine or part in need of washing, the detergent can be provided in the sink 21 with the valve 25 placed in the closed position so that the machine or part can be submerged and washed in the detergent. In such a case, the detergent may be strong acid or alkali solvent.

The basket 80 is placed on the edge of the continuous wall of the sink 21 so that the basket 80 is placed across opening 22. The washed machine or part may be placed and dried in the basket 80.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A worktable apparatus including:

a worktable including posts, a horizontal board supported on the posts, and a vertical board supported on the horizontal board, wherein the vertical board includes a plurality of openings adapted for engagement with hooks;

a washing unit including:

a sink including an opening defined in an upper portion and a drain defined in a lower portion; and a valve connected to the sink so that the drain is in communication with and under control of the valve; and a supporting unit including:

two rails connected to the worktable under the sink;

a tray placed between the rails;

casters divided into two groups each connected to a respective one of two lateral edges of the tray and movably supported on a respective one of the rails;

a nozzle adapted to spray detergent;

a first container adapted to contain the detergent, supported on the tray, and formed with an inlet port to admit pressurized air to the first container and an outlet port in communication with the nozzle to allow the pressurized air to carry the detergent to the nozzle from the first container; and a second container supported on the tray and formed with a port in communication with the valve to admit the detergent, after use, to the second container from the sink.

2. The worktable apparatus according to claim 1, wherein the worktable includes a mat placed on the horizontal board.

3. The worktable apparatus according to claim 2, wherein the mat is useful for avoiding static charges.

4. The worktable apparatus according to claim 1, including a basket supported on the sink so that the basket is placed across the opening.

5. The worktable apparatus according to claim 1, including a flexible pipe for connecting the outlet port to the nozzle.

6. The worktable apparatus according to claim 1, wherein each of the rails includes a stop for stopping one of the casters of a respective group.

* * * * *